US008944747B2

(12) United States Patent
Sarri et al.

(10) Patent No.: US 8,944,747 B2
(45) Date of Patent: Feb. 3, 2015

(54) TURBOMACHINE ACTUATION SYSTEM AND METHOD

(75) Inventors: Franco Sarri, Florence (IT); Giuseppe Iurisci, Florence (IT); Marco Pelella, Florence (IT)

(73) Assignee: Nuovo Pignone S.p.A., Florence (IT)

( * ) Notice: Subject to any disclaimer, the term of this patent is extended or adjusted under 35 U.S.C. 154(b) by 692 days.

(21) Appl. No.: 13/219,291

(22) Filed: Aug. 26, 2011

(65) Prior Publication Data

US 2012/0051896 A1 Mar. 1, 2012

(30) Foreign Application Priority Data

Aug. 31, 2010 (IT) ..... CO2010A0050

(51) Int. Cl.
*F01B 25/02* (2006.01)
*F01D 17/16* (2006.01)

(52) U.S. Cl.
CPC ..... *F01D 17/165* (2013.01)
USPC ..... 415/1; 415/159

(58) Field of Classification Search
USPC ..... 415/159, 160, 164, 165, 1
See application file for complete search history.

(56) References Cited

U.S. PATENT DOCUMENTS 5,799,927 A * 9/1998 Geist ..... 251/212
5,851,104 A * 12/1998 Dakin et al. ..... 415/150
6,256,991 B1 * 7/2001 Schmidt et al. ..... 60/602
6,907,733 B2 * 6/2005 Nishiyama et al. ..... 60/602
7,044,708 B2 * 5/2006 Hausknecht ..... 415/1
7,322,790 B2 * 1/2008 Bouru ..... 415/162
7,406,826 B2 * 8/2008 Hayashi et al. ..... 60/602
2004/0202538 A1 * 10/2004 Hausknecht ..... 415/164
2008/0031728 A1 * 2/2008 Sausse et al. ..... 415/160
2008/0240906 A1 * 10/2008 Barthelet et al. ..... 415/148

FOREIGN PATENT DOCUMENTS

DE 102007031647 A1 1/2007
DE 102007052735 A1 5/2009
EP 2204549 A2 7/2010
FR 2877397 A1 5/2006
GB 2455477 A 6/2009

OTHER PUBLICATIONS

Italian Search Report and Written Opinion, dated Mar. 18, 2011, issued in connection with IT Application No. CO2010A000050 which was filed on Aug. 31, 2010.
Michael Hensges, Simulation and Optimization of an Adjustable Inlet Guide Vane for Industrial Turbo Compressors, from the Proceedings of ASME Turbo Expo 2008: Power for Land, Sea and Air (Jun. 9-13, 2008), Berlin, Germany.

* cited by examiner

*Primary Examiner* — Edward Look
*Assistant Examiner* — Aaron R Eastman
(74) *Attorney, Agent, or Firm* — GE Global Patent Operation

(57) ABSTRACT

An actuation system includes a driving ring configured to rotate and having a groove on an internal face facing a central point of the driving ring; at least a linkage attached with a first end to an inside of the groove; and at least a lever arm attached to a second end of the at least a linkage. At least a portion of the at least a linkage stays inside the groove when the driving ring rotates.

15 Claims, 11 Drawing Sheets

TURBOMACHINE ACTUATION SYSTEM AND METHOD

BACKGROUND OF THE INVENTION

1. Field of the Invention

Embodiments of the subject matter disclosed herein generally relate to methods and devices, and more particularly, to mechanisms and techniques for actuating one or more vanes of a variable inlet guide vanes system.

2. Description of the Prior Art

Actuation systems for adjusting guide vanes are used in turbomachinery equipment, including but not limited to compressors, pumps, and expanders. In particular, variable inlet guide vanes (IGV) may be used in compressor applications to adjust an angle of incidence of inlet air into a first compressor rotor and to control an amount of inlet air to ensure proper surge and to maximize efficiency.

The actuation system may be employed e.g., for recovering methane, natural gas, and/or liquefied natural gas (LNG). The recovered gases may originate from jetty pipelines in the form of boil-off gas (BOG). The recovery of such gasses would reduce emissions and reduce flare operations during the loading of LNG onto ships. Other applications of the actuation system are known in the art.

Variable IGV systems provide a compressor with greater capacity control and reduce energy loss by varying the flow and pressure ratio of air and/or fluids into the compressor based on operating conditions. In this regard, it is noted that a compressor should be lightly loaded when started and then progressively loaded as the compressor becomes fully operational. The IGV system contributes to the control of gas flow during these phases. The variable IGV system is arranged at the inlet of the compressor and the vane blades can be rotated about their aerodynamic center to promote swirl. Moreover, by rotating the vane blades to have an optimal incidence angle with the compressor impeller's leading edge, inlet losses can be minimized.

An example of an adjustable IGV system is shown in FIG. 1, which is reproduced from M. Hensges, Simulation and Optimization of an Adjustable Inlet Guide Vane for Industrial Turbo Compressors from the Proceedings of ASME Turbo Expo 2008: Power for Land, Sea and Air (Jun. 9-13, 2008), the entirety of which is hereby incorporated by reference. FIG. 1 illustrates an adjustable IGV actuation system 100 including an actuator lever 102 directly connected to a first vane 104. The first vane 104 is connected via a drive arm 106 to a driving ring 108. The first vane 104 is rotatably attached to a guide vane carrier 110. A plurality of other vanes 112 are rotatably attached to the guide vane carrier 110. The plurality of vanes 112 are actuated by a plurality of linkages 114 that are connected to the driving ring 108. Thus, when the actuator lever 102 is rotated, it determines a rotation of the first vane 104 but also a displacement of the driving ring 108, which results in a movement of the plurality of linkages 114 and a rotation of the plurality of vanes 110.

In operation, when an actuation force is applied to the actuator lever 102, the force is transferred to the driving ring 108 as an asymmetrical force that causes the driving ring 108 to rotate eccentrically. This happens as the plurality of linkages 114 are linked to the driving ring 108 on a single side of the driving ring, which makes the opposite side of the driving ring 108 free of any force, and thus unbalanced. The asymmetrical forces create a bending torque that may cause the vane assembly to deform, making it susceptible to misalignment and vibrations. Additionally, high actuation forces are required in order to drive the actuator lever 102 to rotate the driving ring 108, which exacerbates the bending torque.

Another approach is to have a geared configuration, i.e., a geared mechanism between the driving ring and the guide vane carrier. However, this approach is not favored by the users as it requires high precision machining, a high actuation force and a design that takes into account the changing temperatures of the teeth.

Still another problem observed in the traditional IGVs is the seizing of the adjustable vanes in applications where the vane assembly is subjected to cryogenic temperatures. This happens when a clearance between the driving ring and its housing is small and the thermal expansions of the driving ring and the housing are different.

Yet another problem observed is that the location of the actuator lever 102 on a lateral side of the variable IGV increases the overall width of the assembly making them unsuitable for applications and installation beyond the first stage of a compressor.

Accordingly it would be desirable to provide methods and devices that avoid that aforementioned problems and drawbacks.

BRIEF SUMMARY OF THE INVENTION

According to an exemplary embodiment, a turbornachine includes a casing; a guide vane carrier attached to the casing, the guide vane carrier having a hole configured to accommodate a shaft; a driving ring facing the guide vane carrier and being configured to rotate relative to the guide vane carrier, the driving ring having a groove on a face facing the shaft; at least a linkage attached with a first end to an inside of the groove; at least a lever arm attached to a second end of the at least a linkage; and at least a vane supported by the guide vane carrier, attached to the at least a lever arm and configured to rotate relative to the guide vane carrier when the driving ring rotates. At least a portion of the at least a linkage stays inside the groove when the driving ring rotates.

According to still another exemplary embodiment, an actuation system includes a driving ring configured to rotate and having a groove on an internal face facing a central point of the driving ring; at least a linkage attached with a first end to an inside of the groove; and at least a lever arm attached to a second end of the at least a linkage. At least a portion of the at least a linkage stays inside the groove when the driving ring rotates.

According to yet another exemplary embodiment, a method for assembling an actuation system is provided. The method includes attaching a first end of at least a linkage to an inside of a groove formed in a driving ring that is configured to rotate, the groove being on an internal face facing a central point of the driving ring; and connecting at least a lever arm to a second end of the at least a linkage. At least a portion of the at least a linkage is inside the groove when the driving ring rotates.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of an actuation system and particularly an actuation system for an inlet gas vane assembly. However, the embodiments to be discussed next are not limited to this system, but may be applied to other systems that control an inflow of fluids or gasses.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, an actuation system may be employed in a compressor for oil and gas type applications. As will be recognized by those skilled in the art, the discussed actuation system may be implemented in a compressor for other applications or in another turbomachine, e.g., pump, expander, etc.

Figure 1:
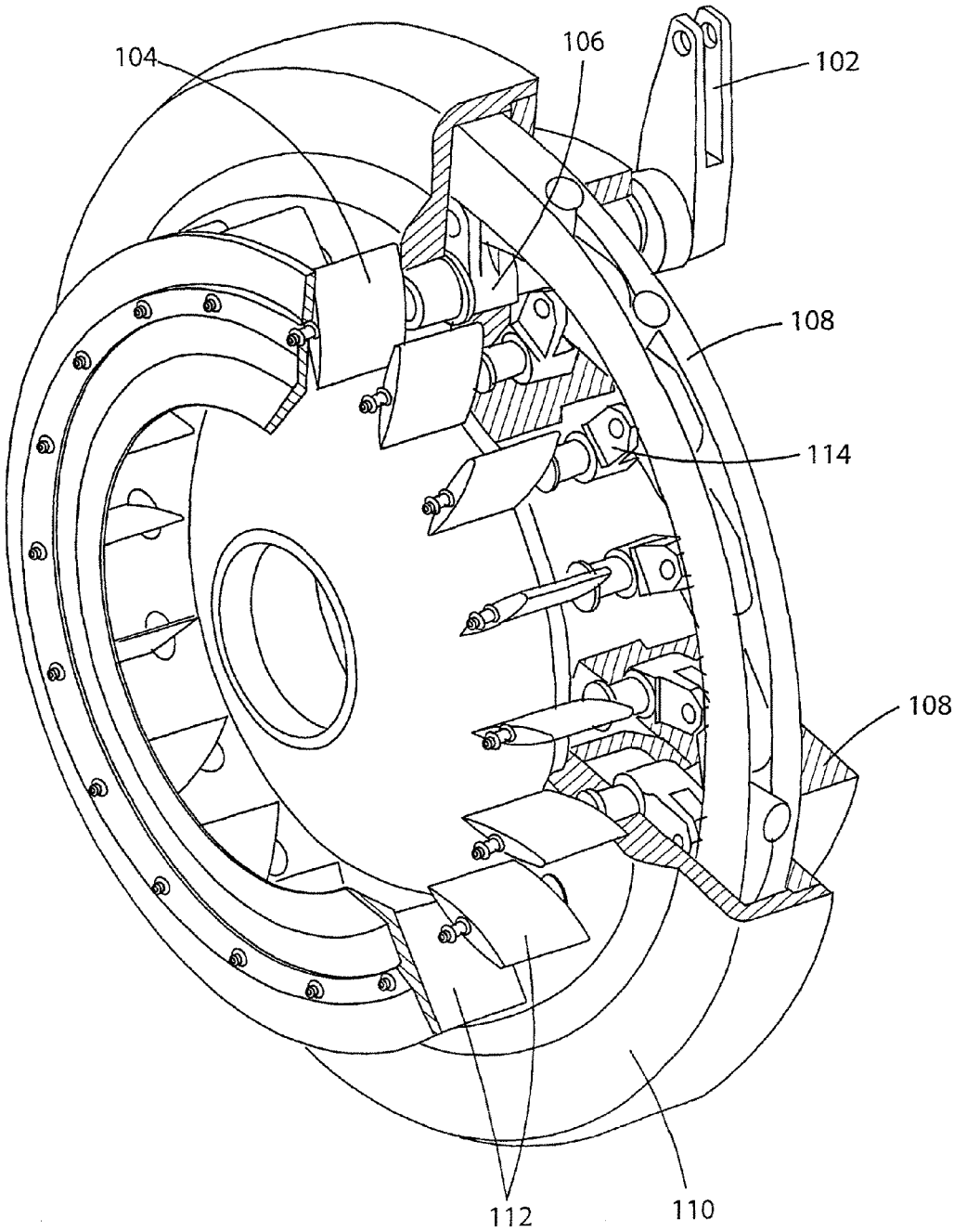
Figure 1 (Background Art)
FIG. 1 is a perspective view of a conventional IGV actuation system.
Figure 2:
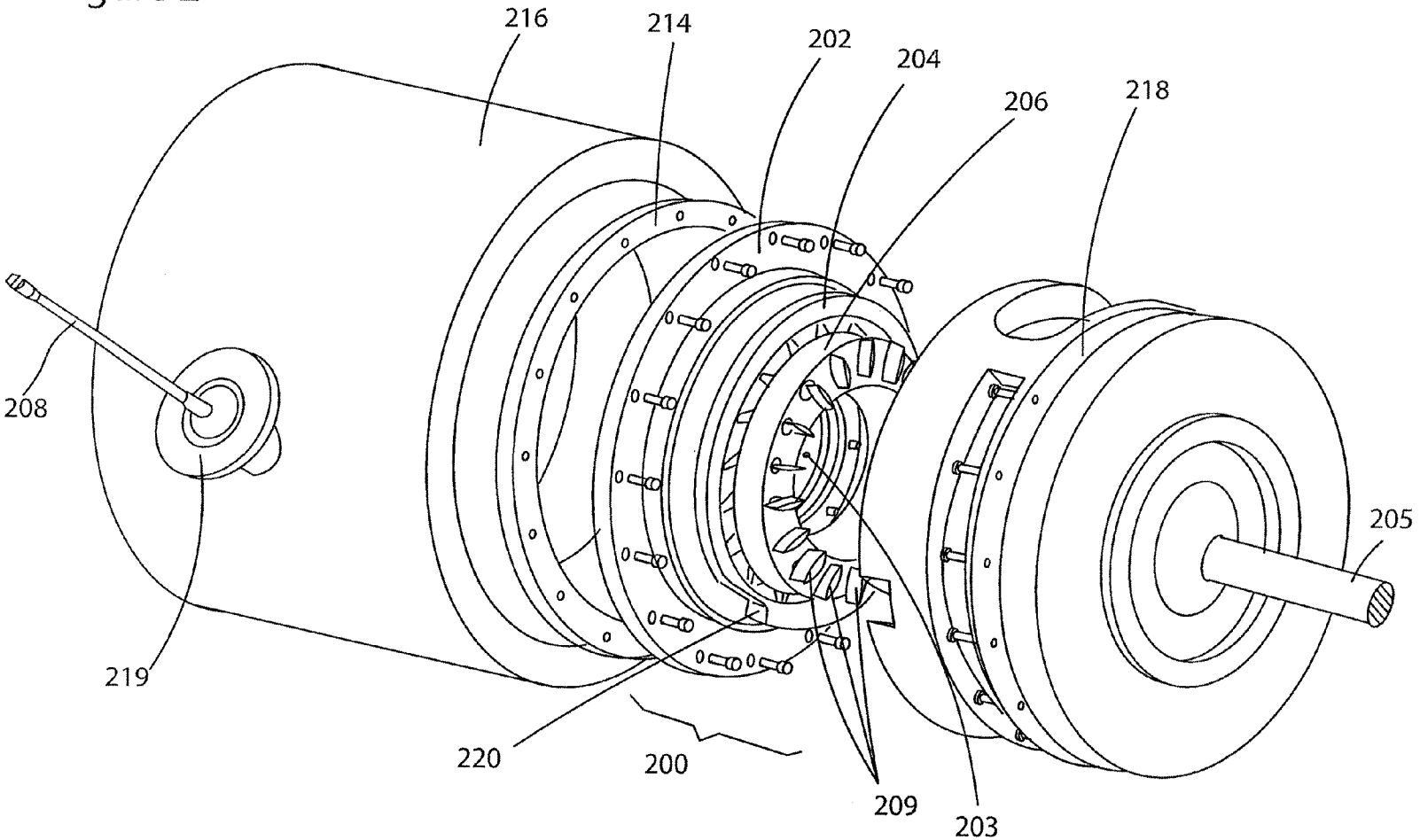
FIG. 2 is an exploded view of an IGV actuation system according to an exemplary embodiment.

According to an exemplary embodiment shown in FIG. 2, an actuation system 200 may include an actuation base plate 202, a driving ring 204, a guide vane carrier 206, and an actuation bar 208. Of course, the actuation system 200 may include more or less of the components noted above. The base plate 202 may have a circular shape with a middle hole 203 for accommodating a shaft 205 of the turbomachine. The base plate 202 may be bolted to an inner casing or to an intermediate diaphragm of the turbomachine. The guide vane carrier 206, as shown in details in FIG. 3, supports a plurality of vanes 209. The plurality of vanes 209 are rotatably connected to the guide vane carrier 206. Lever arms 210 are connected with an end to corresponding vanes 209 and with an opposite end to linkages 212. Linkages 212 are pivotally connected to the driving ring 204. The base plate 202 may be attached to an inner casing 214. A cover 218 may also be, later on, installed inside the casing 216 for sealing off the compressor internals, including the actuation system 200.

An actuation bar 208 may be inserted through a hole 219 in the casing 216 and connected to the driving ring 204 at a connection point 220 by way of fastening means, which may include, but is not limited to, pins, screws, and bolts. The actuation bar 208 may be connected to an actuation device 300 (see FIG. 3), which may provide an actuation force for rotating the driving ring 204. The actuation device 300 may be an electric device, a pneumatic device, a manual device, etc., that is controlled by a user and/or a computing device.

By providing an actuation bar 208 that interacts with a circumferential edge of the driving ring 204, the resultant bending forces exhibited compared with a conventional IGV actuation system are reduced. Additionally, since the actuation bar 208 is located between the base plate 202 and the guide vane carrier 206 in an axial direction, the overall width of the actuation system can be reduced.

Figure 4:
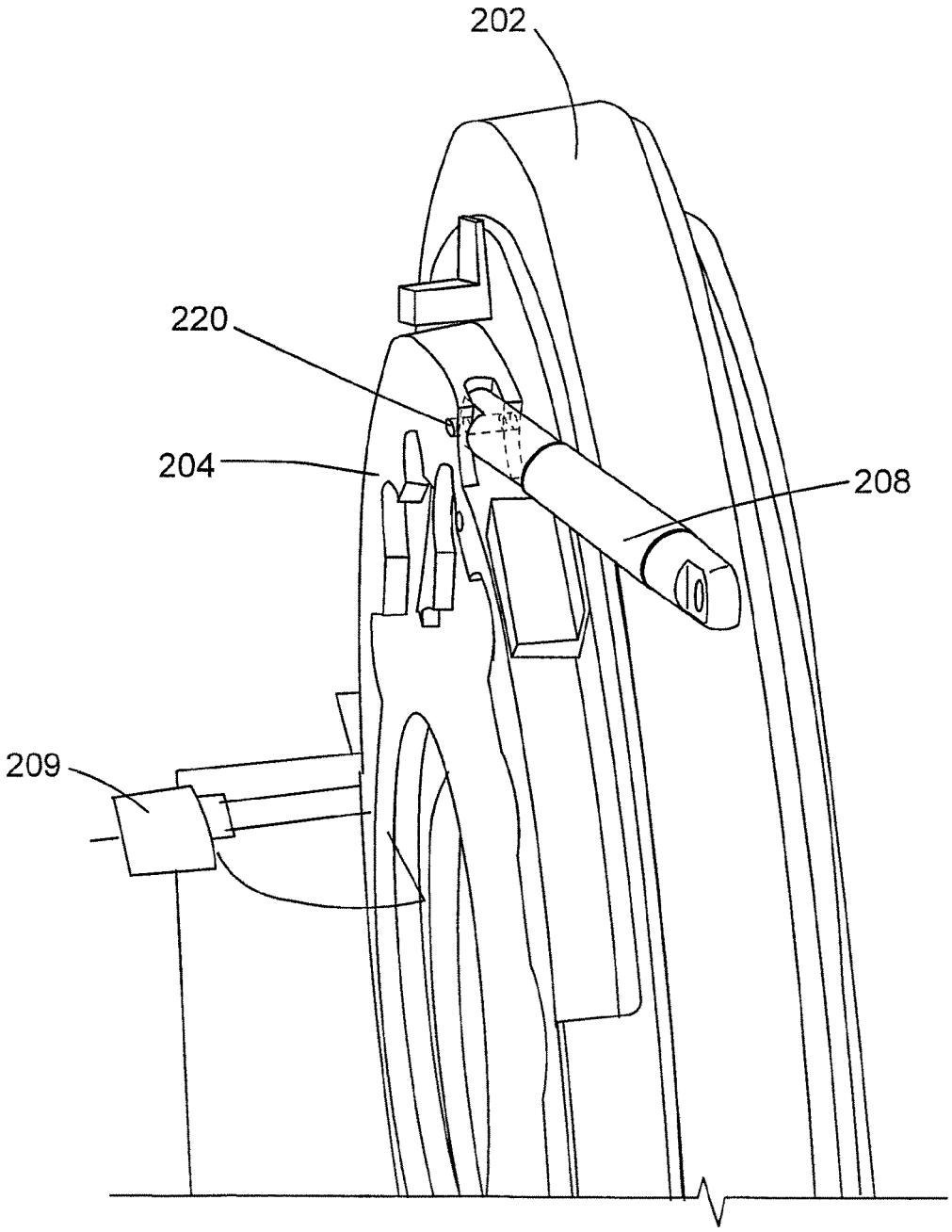
FIG. 4 is a perspective view of selected parts of an IGV actuation system according to an exemplary embodiment.

As illustrated in FIG. 4, the actuation bar 208 is connected to the driving ring 204 at the connection point 220. The connection point 220 may include a slot for accommodating an end of the actuation bar 208 and includes fastener holes positioned perpendicular to the actuation bar 208 once installed. The actuation bar 208 may include at least one end that has at least two substantially flat surfaces for insertion into the slot of the connection point 220. The actuation bar may also include a hole or a fastener retaining mechanism that axially aligns with the connection point's fastener holes. By locating the actuation bar 208 towards the widthwise center of the driving ring 204, torque bending deformations are minimized or eliminated. FIG. 4 also shows vanes 209.

Figure 5A:
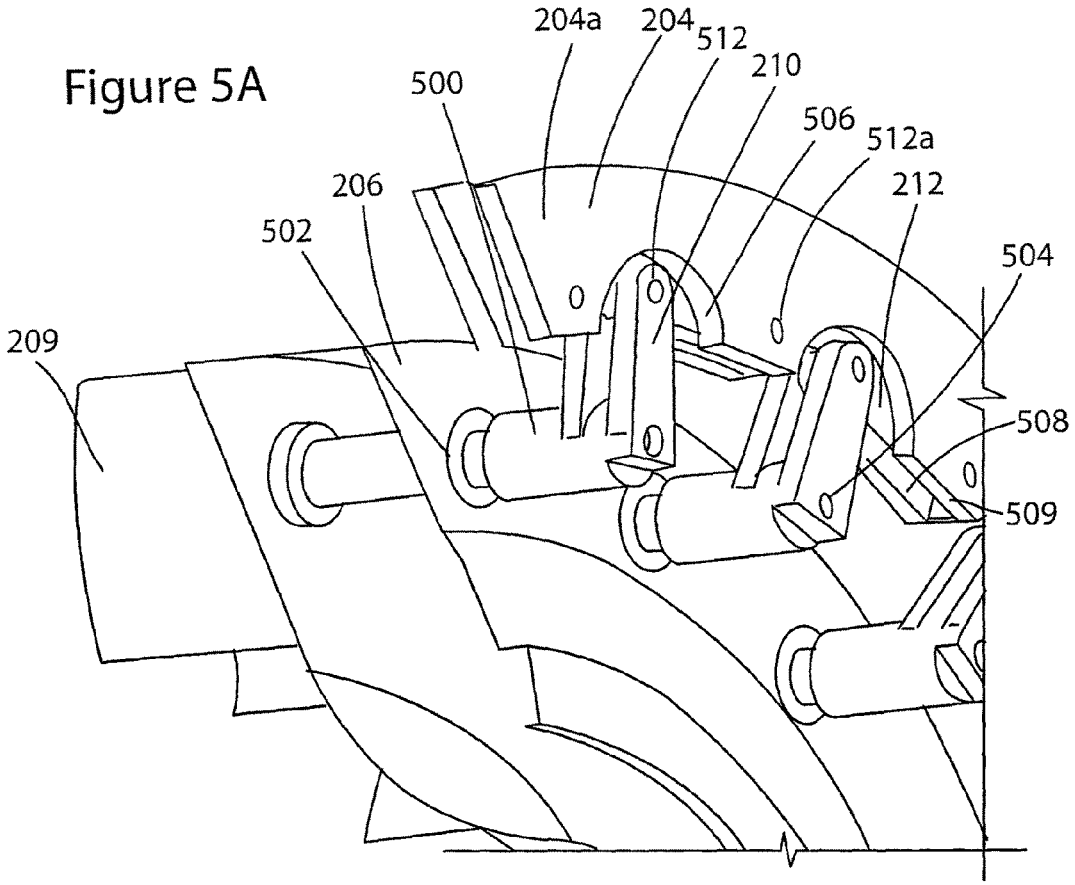
FIG. 5A is a perspective view of a driving ring of an IGV actuation system according to an exemplary embodiment.
Figure 5B:
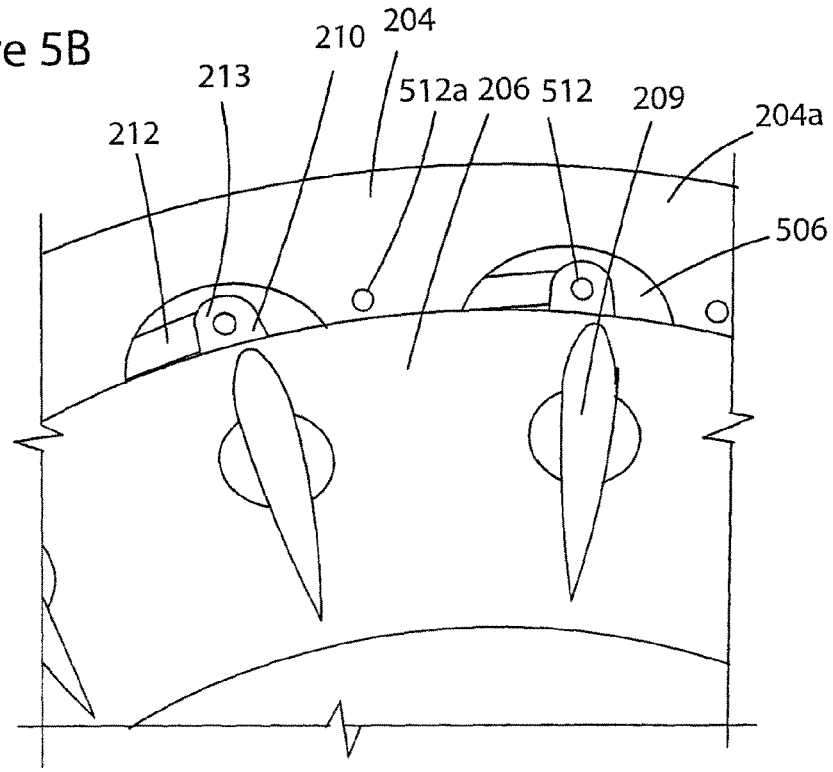
FIG. 5B is a front view of a driving ring of an IGV actuation system according to an exemplary embodiment.

According to an exemplary embodiment illustrated in FIGS. 5A and 5B, the lever arms 210 may be substantially parallel to the planar side surfaces 204*a* of the driving ring 204. Additionally, the lever arms 210 may be attached to rotatable spindles or blade stems 500 that extend at least partially through the width of the guide vane carrier 206. The lever arms 210 and spindles 500 may be two separate components coupled by way of fastening means, which may include, but is not limited to, pins, screws, and bolts, or the two components may be formed integrally.

The lever arms 210 and spindle 500 may be supported directly by the guide vane carrier 206 or they may be supported by way of bearings 502, such as but not limited to bushings or ball bearings. The lever arms 210 and spindle 500 may also be attached to the vanes 209 by fastening means, which may include, but is not limited to, bonding, welding, pins, screws, and bolts.

Similarly, the lever arms 210 may also be attached to the linkages 212 by fastening means, which may include, but is not limited to, pins, screws, and bolts. The lever arms 210 may include lever fastener holes 504 to accommodate the fastening means for attachment to the vanes 209 and/or linkages 212. The linkages 212 may also include linkage fastener holes 512 to accommodate the fastening means for attachment with the lever arms 210 and/or driving ring 204. The driving ring 204 may also include corresponding fastener holes 512*a* to accommodate the fastening means for attachment with the linkages 212.

Figure 6:
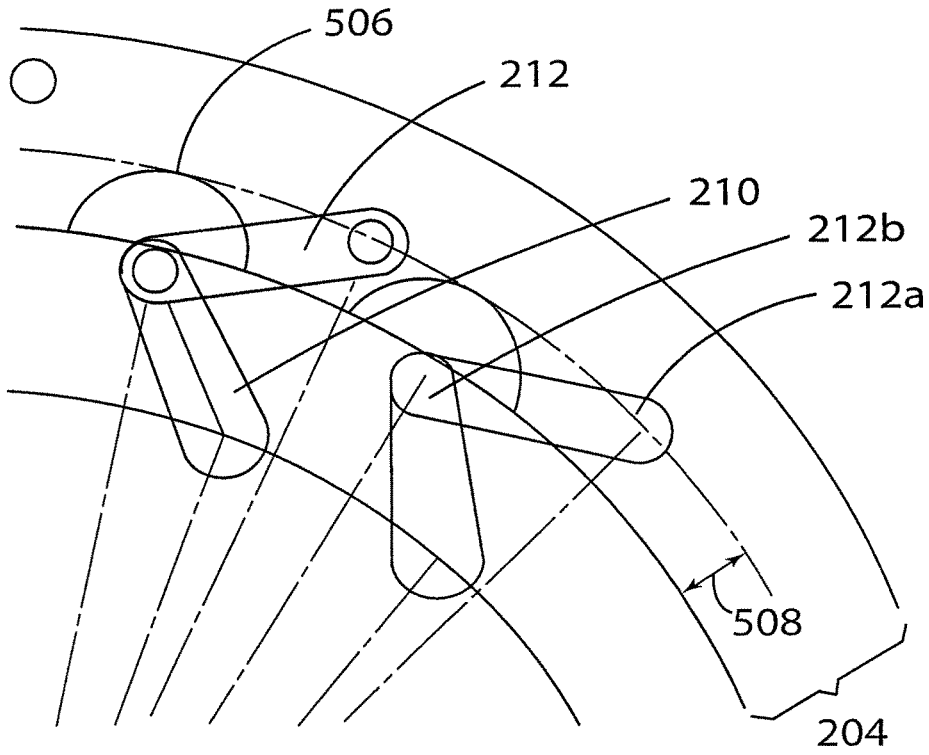
FIG. 6 is a schematic diagram of a groove in a driving ring of an IGV actuation system according to an exemplary embodiment.
Figure 7:
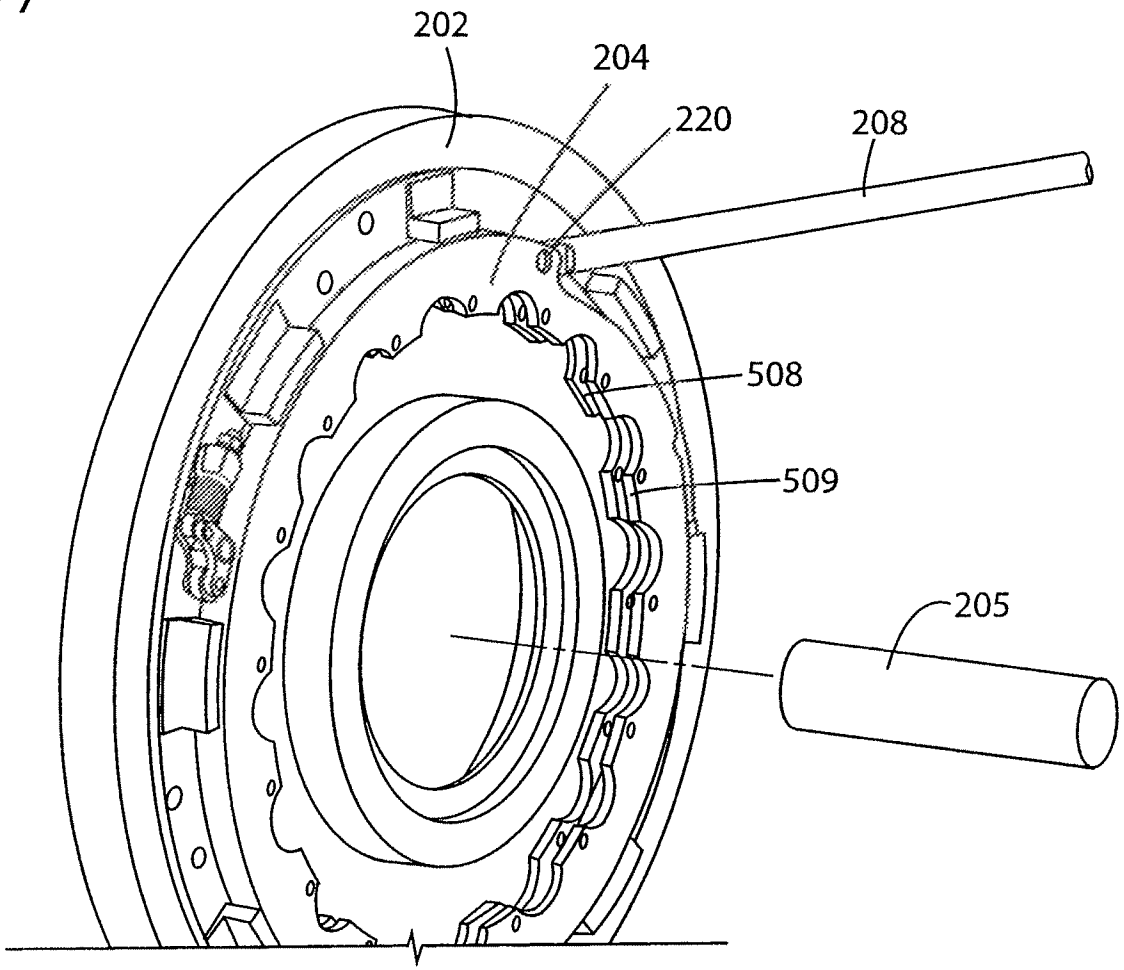
FIG. 7 is a perspective view of a driving ring of an IGV actuation system according to an exemplary embodiment.

According to an exemplary embodiment as illustrated in FIGS. 5A to 6, the lever arms 210 and linkages 212 are at least partially housed within the driving ring 204. FIGS. 5A and 5B show that a linkage 212 may be fully contained inside the driving ring 204 with FIG. 6 shows that the linkage 212 may be partially contained inside the driving ring 204. The linkages 212 are attached to the driving ring 204 by fastening means, which may include but is not limited to, pins, screws, and bolts. In this regard, a first end 212*a* of the linkage 212 is fixed inside a groove 508 formed in the driving ring 204 while a second end 212*b* of the linkage 212, opposite to the first end, is connected to a corresponding lever arm 210. A connection or joint 213 between a linkage 212 and a lever arm 210 is shown in FIG. 5B. The joint 213 may include a hole in each of the linkage and the lever arm and a pin connecting the two elements. When the vanes 209 are fully open, the linkages 212 may be completely housed within the groove 508 of the driving ring 204 as also shown in FIG. 5B.

According to another exemplary embodiment as illustrated in FIGS. 5A to 6, the lever arms 210 and linkages 212 are at least partially housed within driving ring cutouts 506. In this exemplary embodiment, the driving ring cutouts 506 allow for the lever arms 210 to have longer extensions in the direction towards the center of the driving ring 204 without increasing the overall size of the driving ring 204. With longer lever arms 210, a greater mechanical advantage is achieved and the actuation force required to rotate the vanes 209 is ultimately reduced. Also, by housing the linkages 212 inside the driving ring 204, an overall size of the actuation mechanism is reduced comparative with the existing devices.

According to still another exemplary embodiment as illustrated in FIGS. 5A and 5B, the driving ring cutouts 506 may be semi-circular in shape. In yet another exemplary embodiment, the driving ring cutouts may have an asymmetric shape to accommodate the range of motion exhibited by the linkages 212 and the lever arms 210 when the driving ring rotates.

According to an exemplary embodiment as illustrated in FIGS. 5A to 7, the driving ring 204 may include the groove 508 for accommodating the linkages 212. In one application, the groove 508 is at the center of the driving ring 204 in a widthwise direction. The groove 508 is formed on a face 509 of the driving ring 204 that faces the shaft 205. By providing the groove 508 at or near the center of the driving ring 204, a reduced or no bending torque is exerted on the driving ring 204 by the linkages 212 during the actuation of the vanes 209 and therefore, this novel arrangement reduces or eliminates deformations experienced by the driving ring 204.

Figure 8:
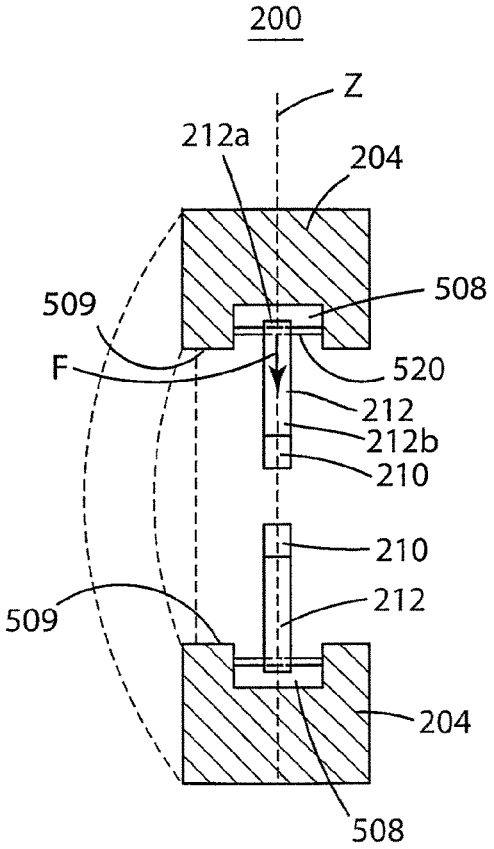
FIG. 8 is a schematic diagram of lever arms and linkages attached to a driving ring according to an exemplary embodiment.
Figure 9:
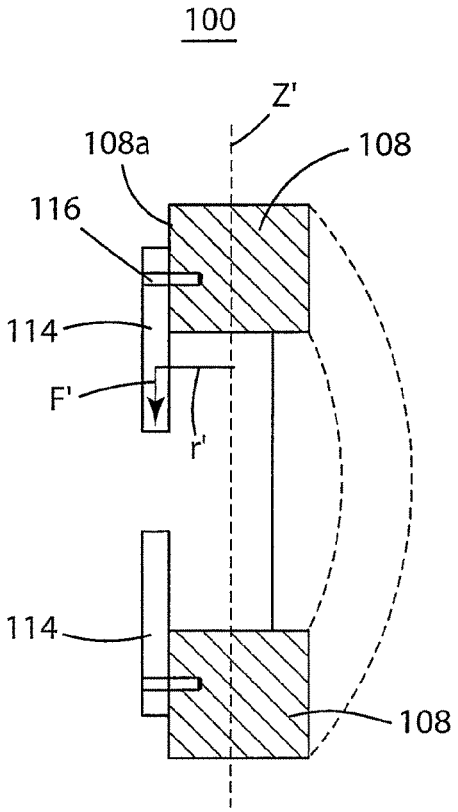
FIG. 9 is a schematic diagram of arms attached to a ring in a conventional device.

In this regard, FIG. 8 shows the novel actuation system 200 compared side by side with the traditional actuation system 100 shown in FIG. 9. It is noted that groove 508 in FIG. 8 is missing in FIG. 9 and for this reason, the arm 114 in FIG. 9 is provided on a side 108*a* of a ring 108. The arm 114 is connected with a pin 116 to the ring 108. However, the linkage 212 in FIG. 8 is connected with the first end 212*a* to an inside of the groove 508, e.g., with a pin 520. A second end 212*b* of the linkage 212 is connected to the arm lever 210.

A force F applied to the linkage 212 determines a torque on the driving ring 204 proportional with a distance of the applied force to a central axis Z of the driving ring 204 as shown in FIG. 8. However, as the force F is along axis Z or close to it, the torque is zero or close to zero. On the contrary, FIG. 9 shows that a distance r' is not zero between the applied force F' and the corresponding axis Z'. It is this torque in FIG. 9 that determines the bending of the ring 108 in the traditional devices.

The groove 508 may include a circumferential channel running along the inner radial surface 509 of the driving ring 204. According to another exemplary embodiment, the groove 508 may include discontinuous segmented channels running along the inner radial surface of the driving ring 204, e.g., there are portions of the surface 509 that have no groove. According to yet another exemplary embodiment, the groove 508 may include a channel that does not follow a circumference of the driving ring 204 but is shaped to accommodate the full range of motion required by the linkages 212 to actuate the lever arms 210.

According to an exemplary embodiment, the lever arms 210 may have forked ends for coupling with the linkages 212 as depicted in FIG. 5A. In another exemplary embodiment, the lever arms may have a single end for coupling with the linkages 212. In yet another embodiment, the linkages may have forked ends for coupling with the lever arms 210, which may include one of a single end and a fork end.

Figure 3:
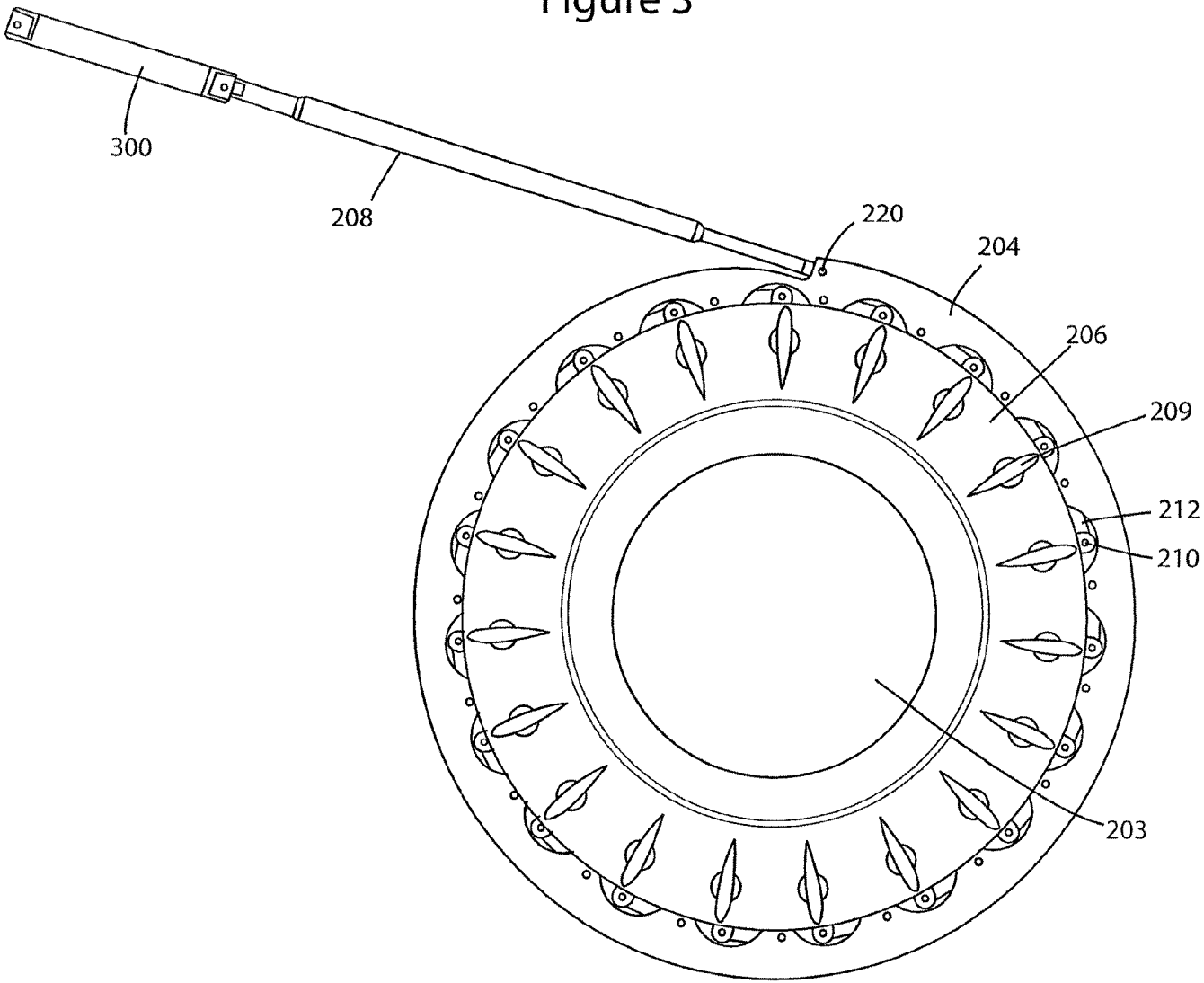
FIG. 3 is a side view of selected parts of an IGV actuation system according to an exemplary embodiment.

As illustrated in FIGS. 3, 5A and 5B, vanes 209 may be actuated to an open position (as pictured) or a closed position (not shown). To adjust the position of the vanes 209, a force is applied on the actuation bar 208 by the actuation device 300 to either push or withdraw the bar 208 with respect to the casing 216. The action is transferred to the driving ring 204 to create a rotational motion and ultimately to alter the position of the vanes 209. As the driving ring 204 rotates about its central axis, the linkages 212 follow along and apply either a pushing or a pulling force on the lever arms 210. As a result of the applied forces, the lever arms 210 rotate to alter the position of the vanes 209.

According to an exemplary embodiment, the actuating bar 208 may have a travel stroke of 100 to 140 mm. The driving ring 204 may have a rotational range of 10 to 18 degrees. The lever arms 210, as well as the vanes 209, may have a rotational range of up to 120 degrees and preferably may have a rotational range of approximately 90 degrees.

Figure 10:
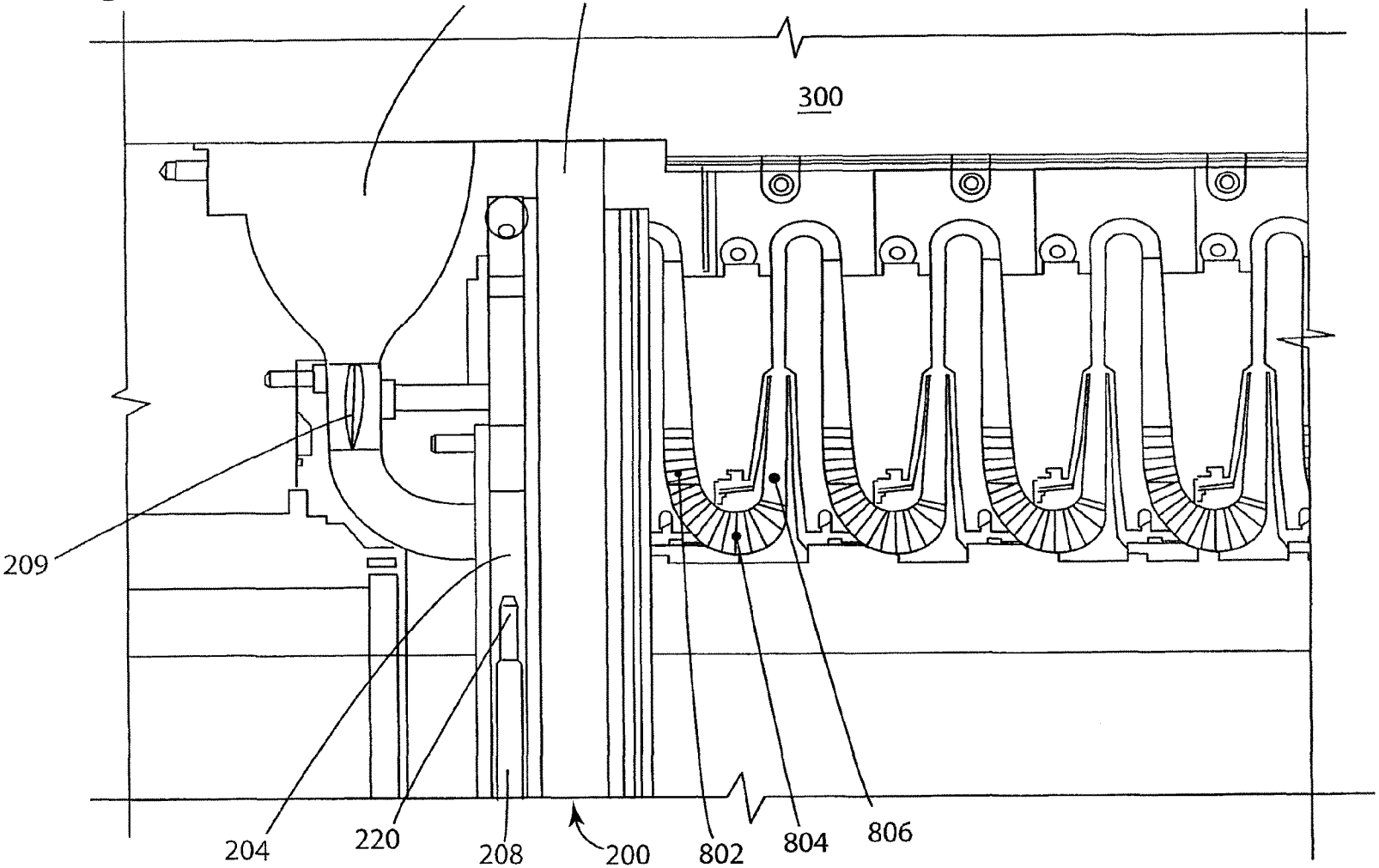
FIG. 10 is a side and cross sectional view of a compressor according to an exemplary embodiment.

In one exemplary embodiment as illustrated in FIG. 10, the completed assembly may be installed in a compressor arrangement 300. The cover 218 shown in FIG. 2 may include an inlet 800 directing an inflow air and/or fluid towards the guide vanes 209. Once the air and/or fluid passes through the actuation system 200, it is then sent to the compressor impeller inlet 802, impeller blades 804, and diffuser 806.

Figure 11:
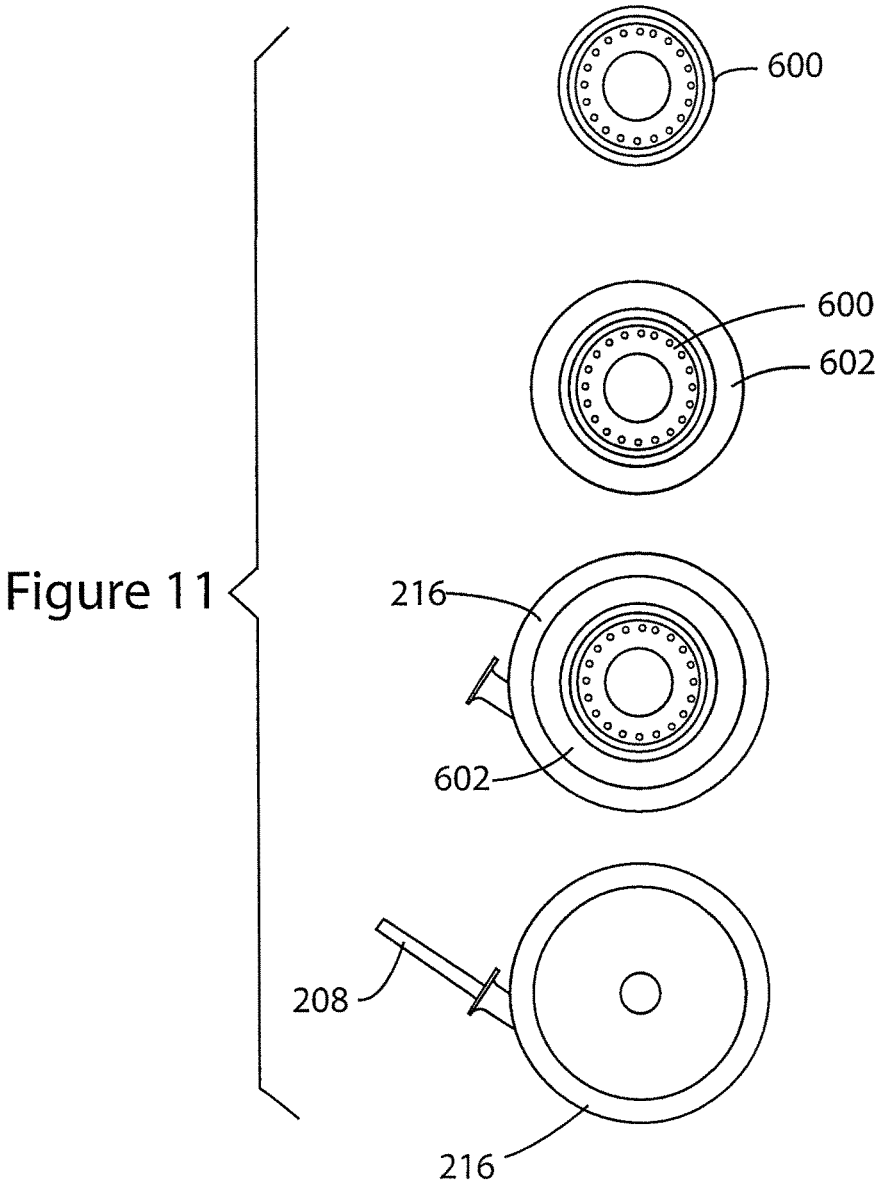
FIG. 11 is a schematic diagram of assembling an IGV actuation system according to an exemplary embodiment.

A method for assembling the actuation system is now discussed with reference to FIG. 11. In a first step for assembling the actuation system, the vanes 209, lever arms 210, guide vane carrier 206, linkages 212, and driving ring 204 are installed together to form a first unit 600. In a next step, the first unit 600 is attached to the actuation base plate 202 and inner casing 214 to form a bundle 602. In the next step, the bundle 602 is then inserted into the casing 216 to form a partially completed assembly. In the next step, actuation bar 208 is also inserted through the casing 216 and connected with the driving ring 204 at the connection point 220. In the last step 908, the cover 218, assembled to the inlet (800) is installed into the casing 216 to complete the compressor assembly. It is noted that in this way the insertion of the actuation bar 208 is performed at the end of the assembly process and the connection point 220 is (e.g., a pin is introduced to attach the actuation bar 208 to the driving ring 204) within easy reach by a person sitting at an opening of the compressor.

Figure 12:
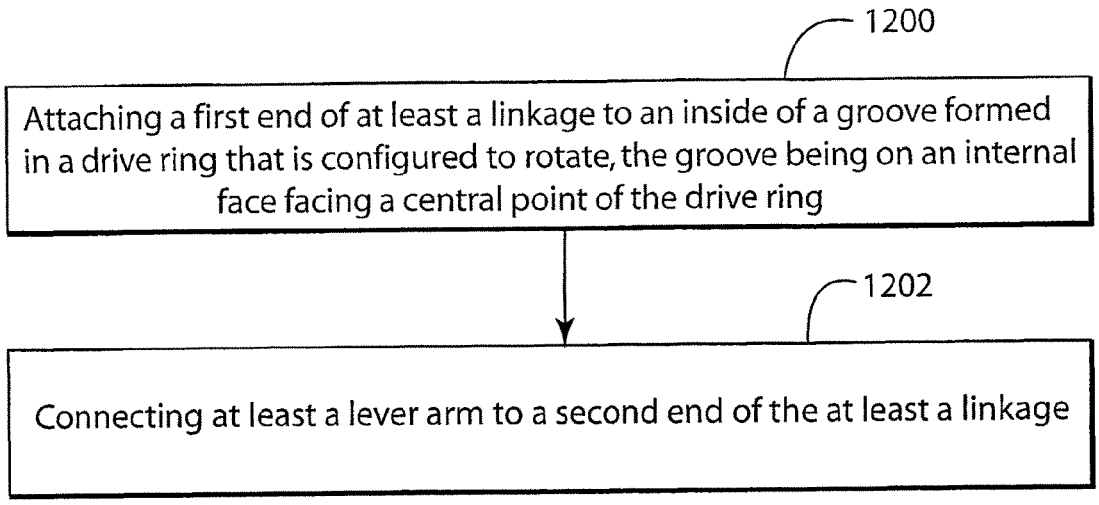
FIG. 12 is a flow chart of a method for assembling an IGV actuation system according to an exemplary embodiment.

A method for assembling the driving ring is now discussed with reference to FIG. 12. The method includes a step 1200 of attaching a first end of at least a linkage to an inside of a groove formed in a driving ring that is configured to rotate, the groove being on an internal face facing a central point of the driving ring, and a step 1202 of connecting at least a lever arm to a second end of the at least a linkage.

The disclosed exemplary embodiments provide an actuation system for the adjusting guide vanes used in turbomachinery. However, it should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbomachine comprising:

a casing;

a guide vane carrier attached to the casing, the guide vane carrier having a hole configured to accommodate a shaft;

a driving ring facing the guide vane carrier and configured to rotate relative to the guide vane carrier, the driving ring having a groove on a face facing the shaft;

at least one linkage attached with a first end to an inside of the groove and wherein the first end is moveable within the driving ring in a direction substantiality concentric to the driving ring;

at least one lever arm attached to a second end of the at least one linkage; and at least one vane supported by the guide vane carrier and attached to the at least one lever arm, the at least one vane configured to rotate relative to the guide vane carrier when the driving ring rotates, wherein at least a portion of the at least one linkage stays inside the groove when the driving ring rotates.

2. The turbomachine of claim 1, wherein the groove is centrally located in a widthwise direction of the driving ring.

3. The turbomachine of claim 1, further comprising:

an inlet attached to a cover; and at least one spindle or a blade stem, configured to pass through the guide vane carrier and connect the at least one blade to the at least one lever arm.

4. The turbomachine of claim 1, wherein the at least one lever arm is a fork.

5. The turbomachine claim 1, wherein the driving ring includes a cutout configured to receive a joint between the at least one lever arm and the at least one linkage.

6. The turbomachine of claim 1, wherein the at least one linkage is configured to be completely inside the groove when the at least one vane is completely open.

7. The turbomachine of claim 1, further comprising;

an impeller attached to the shaft; and an inlet in fluid communication with the impeller, wherein the at least one vane is configured to control an amount of fluid flowing from the inlet to the impeller.

8. An actuation system for a turbomachine for adjusting guide vanes, the actuation system comprising:

a driving ring configured, to rotate and having a groove on an internal face facing a central point of the driving ring;

at least one linkage attached with a first end to an inside of the groove and wherein the first end is moveable within the driving ring in a direction substantially concentric to the driving ring; and at least one lever arm attached to a second end of the at least one linkage, wherein at least a portion of the at least one linkage stays inside the groove when the driving ring rotates.

9. The actuation system of claim 8, further comprising:

a guide vane carrier facing the driving ring and configured to be fixedly attached to a casing of a turbomachine; and at least one vane supported by the guide vane carrier and attached to the at least one lever arm, the at least one vane configured to rotate relative to the guide vane carrier when the driving ring rotates.

10. The actuation system of claim 8, further comprising:

an inlet attached to a cover; and at least one spindle or a blade stem, configured to pass through the guide vane carrier and connect the at least one blade to the at least one lever arm.

11. The actuation system of claim 8, wherein the at least one lever arm is a fork.

12. The actuation system of claim 8, wherein the guide vane carrier includes a cutout configured to receive a joint between the at least one levee arm and the at least one linkage.

13. The actuation system of claim 8, wherein the at least one linkage is configured to be completely inside the groove when the at least one vane is completely open.

14. The actuation system of claim 8, further comprising:

an impeller attached to the shaft; and an inlet in fluid communication with the impeller, wherein the at least One vane is configured to control an amount of fluid flowing from the inlet to the impeller.

15. A method for assembling an actuation system for a turbomachine for adjusting guide vanes, the method comprising:

attaching a first end of at least one linkage to an inside of a groove formed in a driving ring wherein the first end is configured to be moveable within the driving ring in a direction substantially concentric to the driving ring, the groove being on an internal face facing a central point of the driving ring; and connecting at least one lever arm to a second end of the at least one linkage, wherein at least a portion of the at least one linkage is inside the groove when the driving ring rotates.

* * * * *